US007924239B2

(12) United States Patent
Yoshihama et al.

(10) Patent No.: US 7,924,239 B2
(45) Date of Patent: Apr. 12, 2011

(54) IMAGE DISPLAY DEVICE

(75) Inventors: Yutaka Yoshihama, Osaka (JP); Hidehiko Shoji, Osaka (JP); Hironari Taniguchi, Osaka (JP)

(73) Assignee: Panasonic Corporation, Osaka (JP)

( * ) Notice: Subject to any disclaimer, the term of this patent is extended or adjusted under 35 U.S.C. 154(b) by 695 days.

(21) Appl. No.: 11/661,121

(22) PCT Filed: May 15, 2006

(86) PCT No.: PCT/JP2006/309632

§ 371 (c)(1),
(2), (4) Date: Feb. 26, 2007

(87) PCT Pub. No.: WO2006/123599

PCT Pub. Date: Nov. 23, 2006

(65) Prior Publication Data

US 2009/0146922 A1 Jun. 11, 2009

(30) Foreign Application Priority Data

May 17, 2005 (JP) ..... 2005-143777

(51) Int. Cl.
*G09G 3/28* (2006.01)

(52) U.S. Cl. ..... 345/60

(58) Field of Classification Search ..... 345/98–100, 345/60–68

See application file for complete search history.

(56) References Cited

U.S. PATENT DOCUMENTS

| | | | | |
|---|---|---|---|---|
| 6,900,781 | B1 | 5/2005 | Mori et al. | |
| 2004/0239592 | A1 | 12/2004 | Okada | |
| 2005/0162348 | A1 * | 7/2005 | Ogawa et al. | 345/63 |

FOREIGN PATENT DOCUMENTS

| | | | | |
|---|---|---|---|---|
| JP | 3242096 | | | 10/2001 |
| JP | 2002-6805 | | | 1/2002 |
| JP | 2002006805 | A | * | 1/2002 |
| JP | 2003-76321 | | | 3/2003 |
| JP | 2004-206094 | | | 7/2004 |
| JP | 2004206094 | A | * | 7/2004 |

* cited by examiner

*Primary Examiner* — Amr Awad
*Assistant Examiner* — Waseem Moorad
(74) *Attorney, Agent, or Firm* — Wenderoth, Lind & Ponack, L.L.P.

(57) ABSTRACT

An image display device includes a pair of sustain pulse generators for applying either a first sustain pulse or a second sustain pulse to the display electrodes. The first and second sustain pulses generate a sustain discharge twice and once, respectively, in discharge cells when the voltage applied between the display electrodes changes. The application of the first sustain pulse is performed by generating a first discharge by applying a voltage to one of the display electrodes using the clamp corresponding to the one of the display electrodes, and then generating a second discharge by applying a voltage to the other of the display electrodes using the clamp corresponding to the other of the display electrodes. The application of the second sustain pulse is performed by generating a first discharge by applying a voltage to each of the display electrodes using the clamps corresponding to each of the display electrodes.

2 Claims, 10 Drawing Sheets

IMAGE DISPLAY DEVICE

BACKGROUND OF THE INVENTION

This Application is a U.S. National Phase Application of PCT International Application PCT/JP2006/309632.

1. Technical Field

The present invention relates to an image display device with a plasma display panel.

2. Background Art

Plasma display panels (hereinafter, abbreviated as "panels") expanding market size rapidly in recent years are display devices with the advantages of being large, thin, lightweight, and highly visible. The panels, however, are low in emission efficiency, so that various techniques are being developed to improve emission efficiency and to reduce power consumption.

As an example to improve emission efficiency and hence to reduce power consumption by devising a method of driving the panel, the following display device has been developed which includes a first drive part and a second drive part. The first drive part generates a first discharge in a plurality of discharge cells in the display panel by applying a drive pulse to the discharge cells. The second drive part generates a second discharge subsequent to the first discharge by applying a current from a power supply to the discharge cells so as to increase the voltage of the drive pulse which has been decreased along with the first discharge.

In this display device, the first discharge is supplied with minimum electric power necessary for the discharge, so that when the first discharge begins to weaken, the current supply can be limited to reduce ultraviolet saturation, thereby improving the emission efficiency in the first discharge. As a result, the first discharge is generated to have high emission efficiency and is followed by the second discharge in all the discharge cells to be turned on, thereby improving the emission efficiency of the discharge cells. The technical contents are disclosed in Japanese Patent No. 3242096.

However, these consecutive discharges, especially the first discharge, are susceptible to the characteristics and conditions of discharge of each discharge cell and to variations in the component properties of the driving circuits. This makes it uneasy to stably generate the two discharges in all the discharge cells.

SUMMARY OF THE INVENTION

The present invention, which has been devised to solve the aforementioned problems, provides an image display device with emission efficiency improved by stably generating two consecutive discharges.

The image display device of the present invention comprises: a panel including a plurality of discharge cells each having a pair of display electrodes; and a pair of sustain pulse generators applying one of a first sustain pulse and a second sustain pulse to the pair of display electrodes, the first sustain pulse generating a sustain discharge twice in the plurality of discharge cells when a voltage applied between the pair of display electrodes changes, and the second sustain pulse generating a sustain discharge once in the plurality of discharge cells when the voltage applied between the pair of display electrodes changes, wherein each of the pair of sustain pulse generators includes: an electric power recovery part for applying a voltage by charging and discharging the pair of display electrodes by a resonance between an inductor for electric power recovery and an electrostatic capacitance between the pair of display electrodes; and a clamp for applying a voltage by being connected to one of a predetermined power supply and a ground potential, the application of the first sustain pulse is performed by applying a voltage to one of the pair of display electrodes using the electric power recovery part corresponding to the one of the pair of display electrodes; by applying a voltage to an other of the pair of display electrodes using the electric power recovery part corresponding to the other of the pair of display electrodes; by applying a voltage to the one of the pair of display electrodes using the clamp corresponding to the one of the pair of display electrodes so as to generate a first discharge, and later by applying a voltage to the other of the pair of display electrodes using the clamp corresponding to the other of the pair of display electrodes so as to generate a second discharge, the application of the second sustain pulse is performed by applying a voltage to each of the pair of display electrodes using the electric power recovery parts corresponding to each of the pair of display electrodes, and by applying a voltage using the clamps corresponding to each of the pair of display electrodes so as to generate a first discharge. This structure enables the image display device to stably generate the two consecutive discharges so as to improve emission efficiency.

In the image display device of the present invention, it is preferable that the first sustain pulse is applied a predetermined number of times in succession to at least one of the pair of display electrodes, and that the second sustain pulse is applied by being added to the predetermined number of the first sustain pulses. In this structure, when wall voltages have variations for some reason, the wall voltages can be stabilized by generating a discharge with the second sustain pulse.

In the image display device of the present invention, the predetermined number of times can be controlled based on an image signal to be displayed. As a result, the image display device can be driven by an optimum sustain pulse in accordance with the image signal.

Thus, the present invention can provide an image display device with improved emission efficiency by stably generating the two consecutive discharges.

REFERENCE MARKS IN THE DRAWINGS

Figure 1:
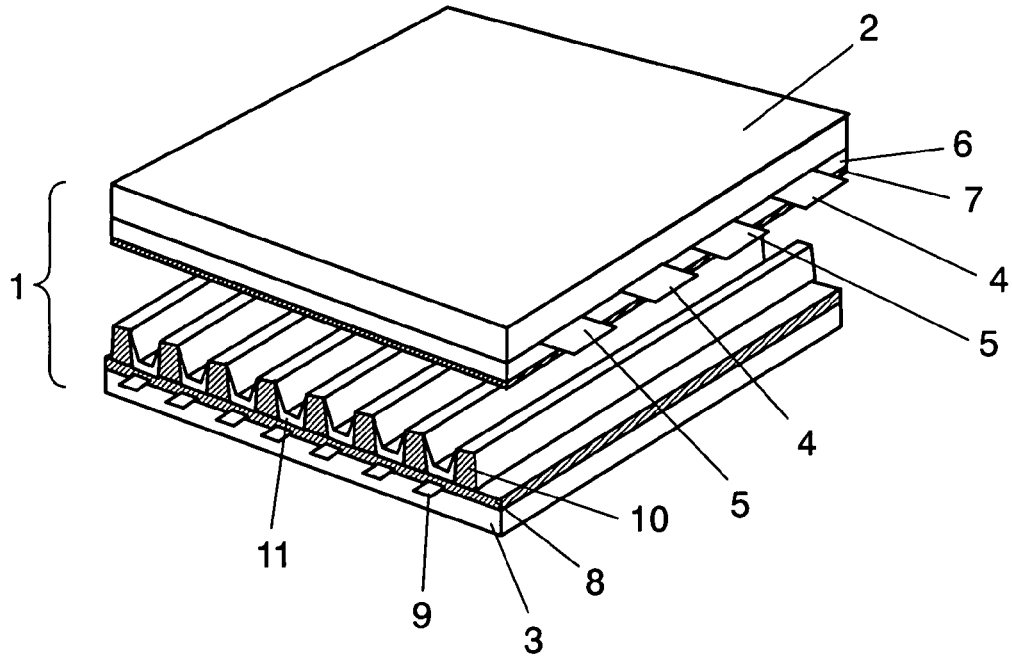
FIG. 1 is an exploded perspective view showing a structure of a panel used in an image display device of a first embodiment of the present invention.

1 panel
2 front substrate
3 rear substrate
4 scan electrode (display electrode)
5 sustain electrode (display electrode)
9 data electrode
12 data electrode driving circuit
13 scan electrode driving circuit
14 sustain electrode driving circuit
15, 25 timing generating circuit
18 image signal processing circuit
24 lighting rate detection circuit
100, 200 sustain pulse generator
110, 210 electric power recovery part
120, 220 clamp

DETAILED DESCRIPTION OF THE INVENTION

An image display device of embodiments of the present invention will be described with reference to drawings.

First Exemplary Embodiment

FIG. 1 is an exploded perspective view showing the structure of a panel used in the image display device of a first embodiment of the present invention. Panel 1 includes front substrate 2 and rear substrate 3 which are made of glass and disposed opposite to each other, and a discharge space formed therebetween. Front substrate 2 is provided thereon with scan electrodes 4 and sustain electrodes 5 arranged in parallel so as to form display electrodes. Electrodes 4 and sustain electrodes 5 are coated with dielectric layer 6 which is further coated with protective layer 7. On the other hand, rear substrate 3 is provided thereon with data electrodes 9 coated with insulating layer 8. Insulating layer 8 has barrier ribs 10 formed between and in parallel with data electrodes 9. The surface of insulating layer 8 and side surfaces of barrier ribs 10 are provided with phosphor layers 11. Front substrate 2 and rear substrate 3 are disposed opposite to each other in such a manner that scan electrodes 4 and sustain electrodes 5 cross data electrodes 9. The discharge space formed between the substrates is filled with a mixture of, for example, neon and xenon gases as a discharge gas.

Figure 2:
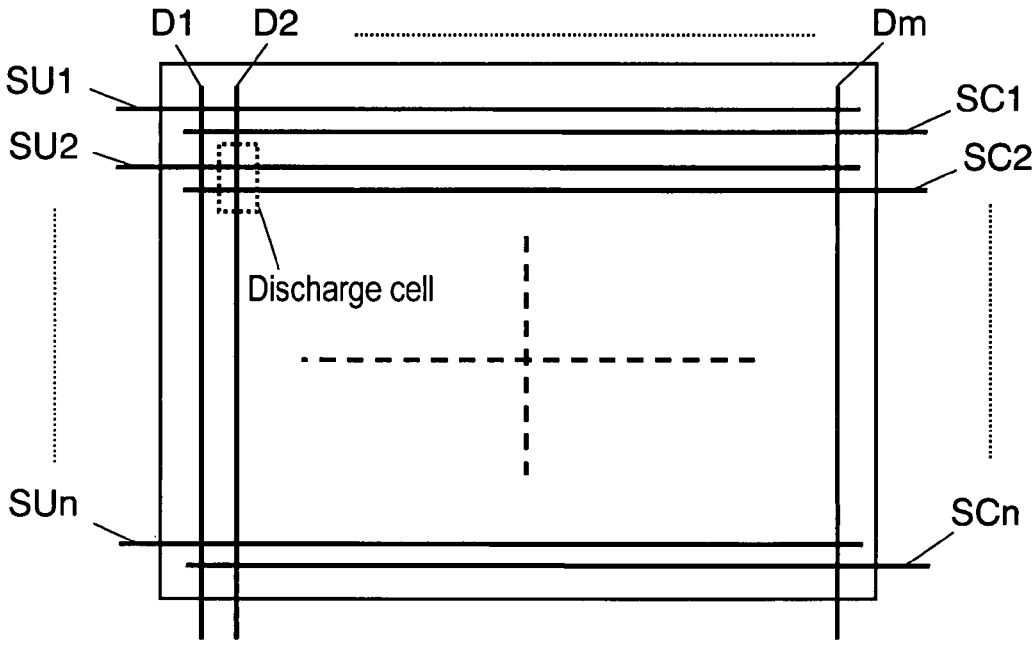
FIG. 2 is an electrode array in the panel used in the image display device of the first embodiment.

FIG. 2 is an electrode array in the panel. In the row direction, n scan electrodes SC1 to SCn (corresponding to scan electrodes 4 shown in FIG. 1) and n sustain electrodes SU1 to SUn (corresponding to sustain electrodes 5 shown in FIG. 1) are arranged alternately. In the column direction, m data electrodes D1 to Dm (corresponding to data electrodes 9 shown in FIG. 1) are arranged. A discharge cell is formed where one pair of scan electrode SC1 and sustain electrode SUi (i=1 to n) and one data electrode Dj (j=1 to m) cross each other, and a total of m×n discharge cells are formed in the discharge space. As shown in FIGS. 1 and 2, scan electrodes SC1 to SCn and sustain electrodes SU1 to SUn are formed in parallel pairs and therefore have a large interelectrode capacitance therebetween.

Figure 3:
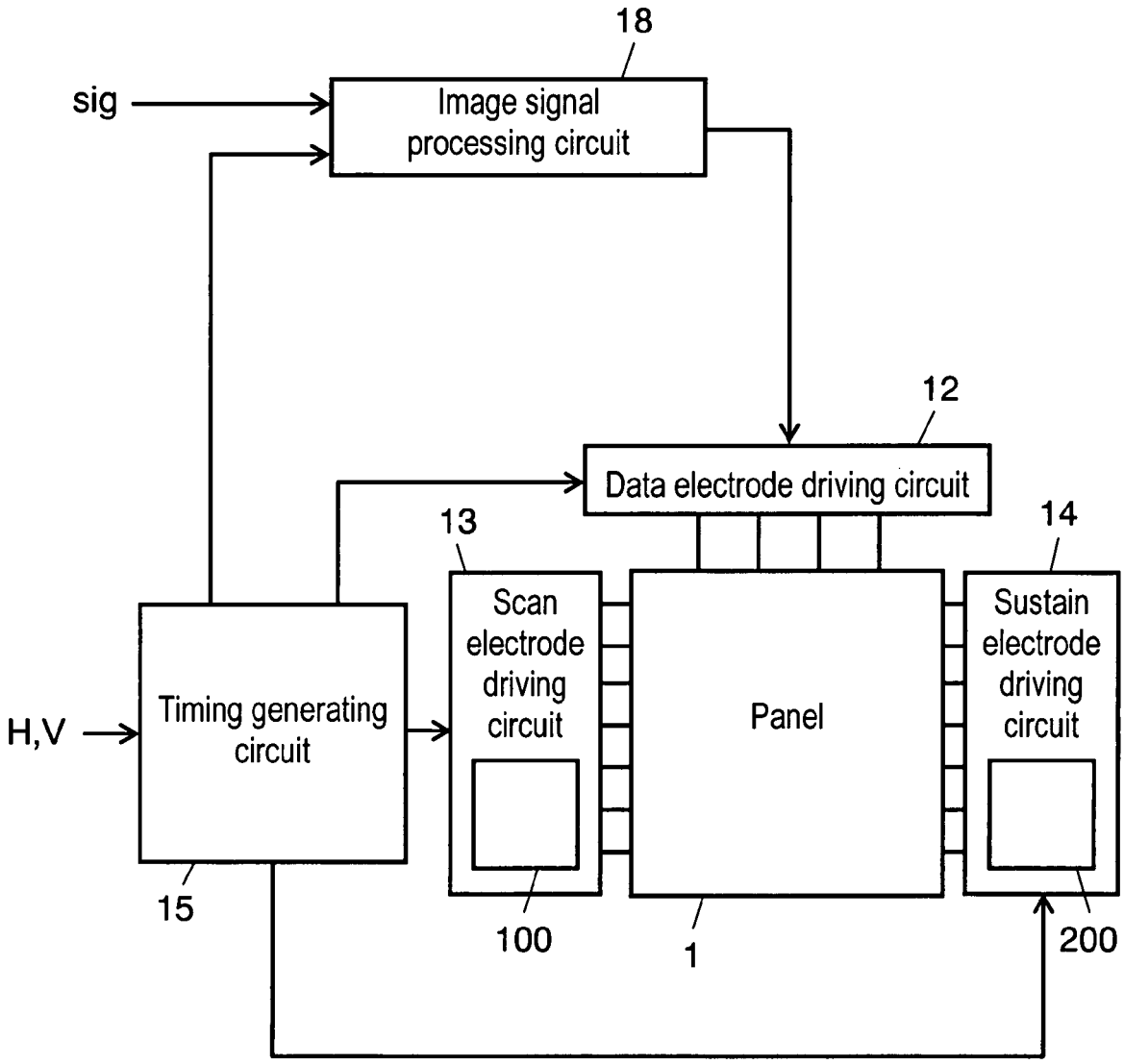
FIG. 3 is a circuit diagram of the image display device of the first embodiment.

FIG. 3 is a circuit diagram of the image display device of the first embodiment of the present invention. This image display device includes panel 1, data electrode driving circuit 12, scan electrode driving circuit 13, sustain electrode driving circuit 14, timing generating circuit 15, image signal processing circuit 18, and a power supply circuit (unillustrated).

Image signal processing circuit 18 converts an image signal "sig" to image data for each subfield. Data electrode driving circuit 12 converts the image data for each subfield to a signal corresponding to each of data electrodes D1 to Dm and drives data electrodes D1 to Dm. Timing generating circuit 15 generates various timing signals based on a horizontal synchronizing signal H and a vertical synchronizing signal V and supplies them to each circuit block. Scan electrode driving circuit 13 provides scan electrodes SC1 to SCn with drive voltage waveforms based on a timing signal, and sustain electrode driving circuit 14 provides sustain electrodes SU1 to SUn with drive voltage waveforms based on another timing signal. Scan electrode driving circuit 13 includes sustain pulse generator 100 for generating a sustain pulse, which will be described later, and similarly, sustain electrode driving circuit 14 includes sustain pulse generator 200. Sustain pulse generators 100 and 200 can generate several kinds of sustain pulses which will be detailed later. Sustain pulse generators 100 and 200 each include an electric power recovery part in order to recover the electric power due to the charge and discharge of the interelectrode capacitance between scan electrodes 4 and sustain electrodes 5.

The following is a description of the drive voltage waveforms to drive the panel and the driving operation. In the first embodiment of the present invention, one field is divided into a plurality of subfields each having an initialization period, a write period, and a sustain period.

Figure 4:
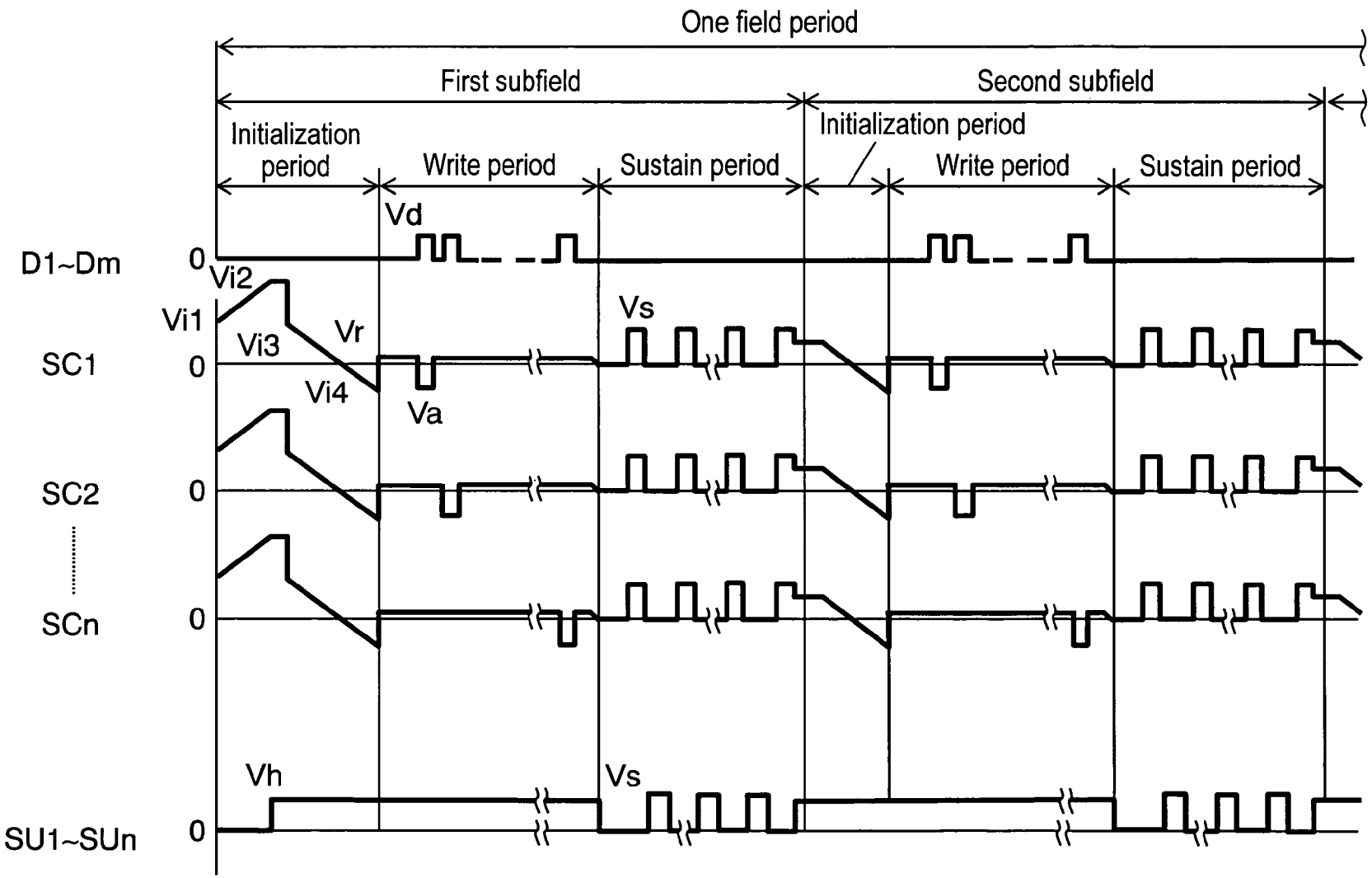
FIG. 4 is a view showing drive voltage waveforms applied to electrodes in the panel used in the image display device of the first embodiment.

FIG. 4 is a view showing drive voltage waveforms applied to the electrodes in the panel of the first embodiment of the present invention. In the initialization period of the first subfield, data electrodes D1 to Dm and sustain electrodes SU1 to SUn are held at 0 (V), and scan electrodes SC1 to SCn are subjected to a ramp voltage gradually increasing from a voltage Vi1 (V) to reach a voltage Vi2 (V). The voltage Vi1 (V) is not more than the starting voltage and the voltage Vi2 (V) exceeds the starting voltage. As a result, a first weak initialization discharge is generated in all the discharge cells to store negative wall voltages on scan electrodes SC1 to SCn and positive wall voltages on sustain electrodes SU1 to SUn and on data electrodes D1 to Dm. The term "wall voltage" stored on an electrode indicates a voltage generated by wall charges accumulated on the dielectric layer or the phosphor layer which coat the electrodes. Later, scan electrodes SC1 to SCn are subjected to a ramp voltage gradually decreasing from a voltage Vi3 (V) to reach a voltage Vi4 (V), while sustain electrodes SU1 to SUn are being held at a positive voltage Vh (V). As a result, a second weak initialization discharge is generated in all the discharge cells to weaken the wall voltages on scan electrodes SC1 to SCn and the wall voltages on sustain electrodes SU1 to SUn. This results in the adjustment of the wall voltages on data electrodes D1 to Dm to values appropriate for writing operation.

In the subsequent write period, scan electrodes SC1 to SCn are once held at a voltage Vr (V). Then, of data electrodes D1 to Dm, data electrode Dk (k=1 to m) of the discharge cell to be displayed on the first row is subjected to a positive write pulse voltage Vd (V), and scan electrode SC1 on the first row is subjected to a scan pulse voltage Va (V). In this case, the intersection point of data electrode Dk and scan electrode SC1 has a voltage which is equal to the total of an externally applied voltage (Vd−Va) (V), the wall voltage on data electrode Dk, and the wall voltage on scan electrode SC1, and the total exceeds the starting voltage. A write discharge is generated between data electrode Dk and scan electrode SC and between sustain electrode SU1 and scan electrode SC1. A positive wall voltage is accumulated on scan electrode SC1 of this discharge cell, and a negative wall voltage is accumulated on sustain electrode SU1 and on data electrode Dk. Thus, the write discharge is generated in the discharge cell to be displayed on the first row, thereby performing a writing operation to accumulate the wall voltage on each electrode. On the other hand, the intersection points of data electrodes D1 to Dm that have not been subjected to the positive write pulse voltage Vd (V) and scan electrode SC1 have a voltage not exceeding the starting voltage, so that no write discharge is generated. The above-described writing operation is applied up to the discharge cells on the nth row so as to terminate the write period.

In the subsequent sustain period, a sustain pulse voltage Vs (V) is applied between scan electrodes SC1 to SCn and sustain electrodes SU1 to SUn so as to generate a discharge and to emit light selectively in the discharge cell which has formed a wall charge due to the write discharge. The sustain pulse and the sustain discharge in this case will be briefly described as follows and in detail later. First, sustain electrodes SU1 to SUn are subjected to a voltage of 0 (V), and scan electrodes SC1 to SCn are subjected to the positive sustain pulse voltage Vs (V). In the discharge cell in which the write discharge has occurred, the voltage between the top of scan electrode SCi and the top of sustain electrode SUi is equal to the total of the sustain pulse voltage Vs (V), the wall voltage on scan electrode SCi, and the wall voltage on sustain electrode SUi, and the total exceeds the starting voltage. Scan electrode SCi and sustain electrode SUi generate a sustain discharge therebetween, and the ultraviolet light generated in this case allows phosphor layers 11 to emit light. As a result, a negative wall voltage is accumulated on scan electrode SCi, and a positive wall voltage is accumulated on sustain electrode SUi. In addition, a positive wall voltage is also accumulated on data electrode Dk. In the discharge cells in which no write discharge has occurred in the write period, no sustain discharge occurs, so that the wall voltage condition at the end of the initialization period is maintained. Then, scan electrodes SC1 to SCn are subjected to a voltage of 0 (V), and sustain electrodes SU1 to SUn are subjected to the positive sustain pulse voltage Vs (V). In the discharge cell in which the sustain discharge has occurred, the voltage between the top of sustain electrode SUi and the top of scan electrode SCi exceeds the starting voltage. This causes another sustain discharge between sustain electrode SUi and scan electrode SCi. A negative wall voltage is accumulated on sustain electrode SUi, and a positive wall voltage is accumulated on scan electrode SCi. Hereinafter, in the same manner, the number of sustain pulses corresponding to the luminance weight is applied alternately to scan electrodes SC1 to SCn and sustain electrodes SU1 to SUn. This allows the sustain discharge to be continued in the discharge cell in which the write discharge has occurred in the write period. Thus, the sustain operation in the sustain period is terminated.

In the subsequent subfield, the operations in the initialization period, the write period, and the sustain period will not be described because they are equal to those in the first subfield.

Sustain pulse generators 100 and 200 of scan electrode driving circuit 13 and sustain electrode driving circuit 14, respectively, generate the above-described sustain pulse in the sustain period and apply the pulse to scan electrodes 4 and sustain electrodes 5, respectively.

Figure 5:
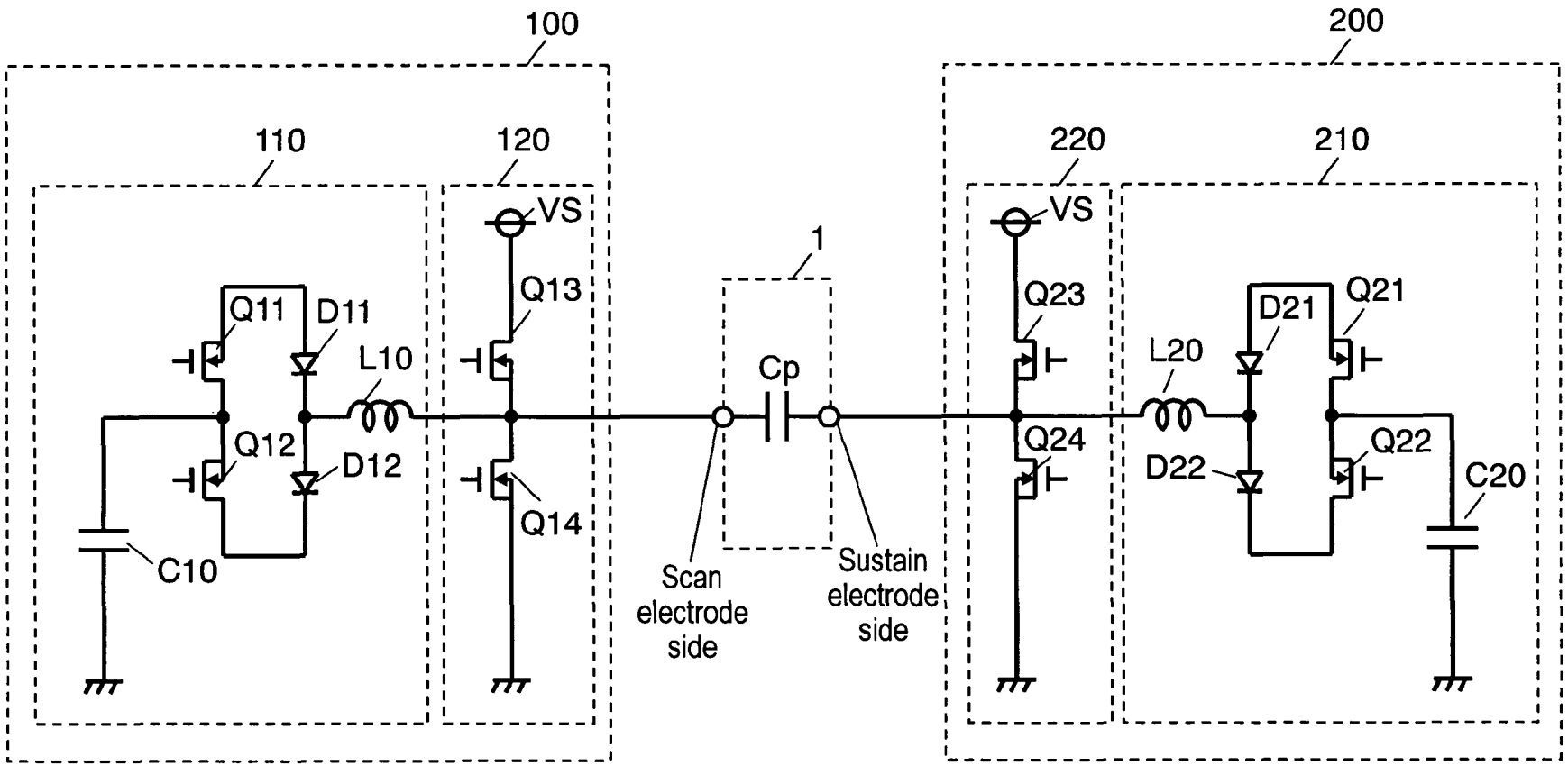
FIG. 5 is a circuit diagram of sustain pulse generators of the image display device of the first embodiment.

FIG. 5 is a circuit diagram of sustain pulse generators 100 and 200 of the image display device of the first embodiment of the present invention. Sustain pulse generator 100 is composed of electric power recovery part 110 and clamp 120. Electric power recovery part 110 includes capacitor C10 for electric power recovery, switching elements Q11 and Q12, diodes D11 and D12 for backflow prevention, and inductor L10 for electric power recovery. Clamp 120 includes power supply VS with a voltage value of Vs (V) and switching elements Q13 and Q14. Electric power recovery part 110 and clamp 120 are connected to scan electrodes 4 which are one end of the interelectrode capacitance Cp of panel 1 via a scan pulse generating circuit. Note that the scan pulse generating circuit is not shown in FIG. 5. Capacitor C10 has a capacity much larger than the interelectrode capacitance Cp and is charged so as to have a voltage value of about Vs/2 (V), thereby functioning as the power supply of electric power recovery part 110. Sustain pulse generator 200, which has nearly the same circuit structure as sustain pulse generator 100, is composed of electric power recovery part 210 and clamp 220. Electric power recovery part 210 includes capacitor C20 for electric power recovery, switching elements Q21 and Q22, diodes D21 and D22 for backflow prevention, and inductor L20 for electric power recovery. Clamp 220 includes power supply VS and switching elements Q23 and Q24. The output of sustain pulse generator 200 is connected to sustain electrodes 5 which are the other end of the interelectrode capacitance Cp of panel 1.

The sustain pulse voltage and the sustain discharge will be described in detail as follows. In the first embodiment of the present invention, a sustain discharge is performed using two kinds of sustain pulses: a first sustain pulse which can stably generate two consecutive discharges and a second sustain pulse which can stably continue the sustain discharge by stabilizing the wall voltages.

Figure 6:
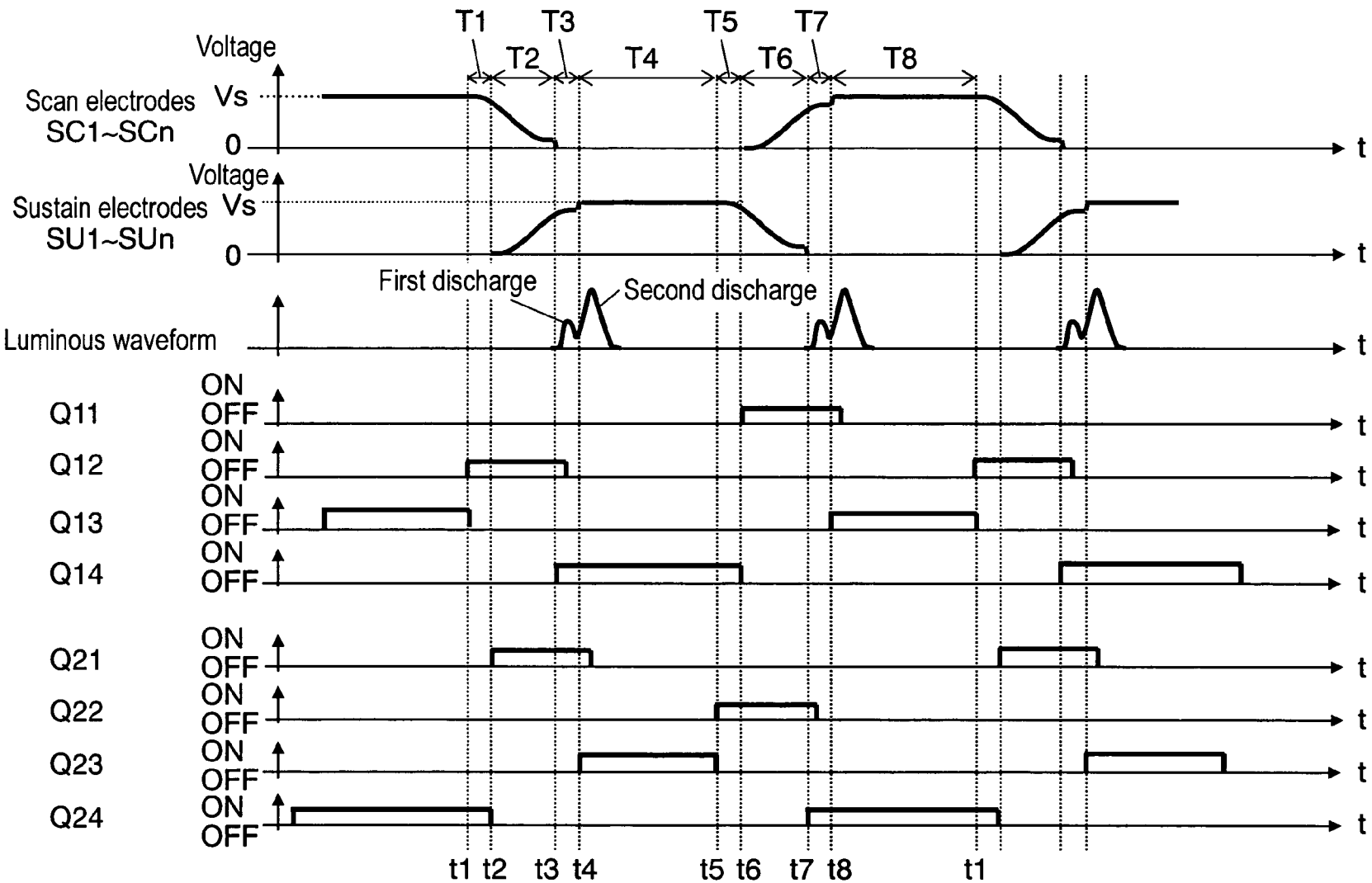
FIG. 6 is a timing chart showing details of a first sustain pulse in the image display device of the first embodiment.

FIG. 6 is a timing chart showing details of the first sustain pulse in the first embodiment of the present invention. First, one cycle of the first sustain pulse is divided into eight periods T1 to T8 shown in FIG. 6 and each period will be described as follows. The sustain pulse applied to scan electrodes 4 and the sustain pulse applied to sustain electrodes 5 are different in phase but equal in waveform to each other. Therefore, the operations by scan electrodes 4 from period T1 to T4 and from period T5 to T8 are equal to the operations by sustain electrodes 5 from period T5 to T8 and from period T1 to T4, respectively, so that the description will be omitted.

(1) Period T1

At time t1, switching element Q12 is turned on. This causes the charge on the scan electrode 4 side to flow to capacitor C10 via inductor L10, diode D12, and switching element Q12, making the voltage of scan electrodes 4 begin to fall. Since inductor L10 and the interelectrode capacitance Cp form a resonance circuit, the voltage of scan electrodes 4 falls to around 0 (V) at time t3 when ½ of the resonance period has elapsed.

(2) Period T2

At time t2, switching element Q21 is turned on. This causes a current to flow from capacitor C20 for electric power recovery via switching element Q21, diode D21, and inductor L20, making the voltage of sustain electrodes 5 begin to rise. Since inductor L20 and the interelectrode capacitance Cp form a resonance circuit, the voltage of sustain electrodes 5 rises to around a Vs (V) at time t4 when ½ of the resonance period has elapsed.

(3) Period T3

At time t3, the voltage of scan electrodes 4 falls to around 0 (V) as described above, but not reach 0 (V) due to the power loss of the resistance component of the resonance circuit and the like. At time t3, switching element Q14 is turned on. This allows scan electrodes 4 to be directly grounded via switching element Q14, so that their voltage is forced to 0 (V). At this moment, the voltage of sustain electrodes 5 rises sufficiently and exceeds the starting voltage in the discharge cell in which the write discharge has occurred. The voltage drop in scan electrodes 4 triggers the generation of a first discharge. When the first discharge reaches a certain intensity and the amount of ultraviolet light generated by the discharge begins to saturate, the current required for the discharge exceeds the current capability of electric power recovery part 210 on the sustain electrode side. As a result, the first discharge begins to weaken, so that the amount of ultraviolet light generated by the discharge current does not reach saturation, thereby improving emission efficiency.

(4) Period T4

At time t4, switching element Q23 is turned on. This allows sustain electrodes 5 to be directly connected to power supply VS via switching element Q23, so that their voltage is forced to the Vs (V). The voltage rise triggers the generation of a second discharge. The second discharge can be stable because it is generated when a sufficient priming of the first discharge is still left. The second discharge can also be strong with no limitation on the amount of the discharge current so as to accumulate a wall voltage required to continue the sustain discharge. This is because scan electrodes 4 are connected to the ground potential, and sustain electrodes 5 are connected to power supply VS. Furthermore, the second discharge has a high emission efficiency because it is performed when the effective voltage applied on the discharge space is reduced by the first discharge, that is, when the voltage is comparatively low.

Switching element Q12 has only to be turned off after time t3 and before time t6, and switching element Q21 has only to be turned off after time t4 and before time t5. In order to reduce the output impedances of sustain pulse generators 100 and 200, it is preferable to turn off switching element Q14 immediately before time t6 and switching element Q23 immediately before time t5.

The mechanism that the sustain discharge generated by the first sustain pulse can improve emission efficiency is not elucidated completely. However, as described above, the improvement seems to be achieved by the absence of the saturation of the ultraviolet light in the first discharge and the generation of the second discharge at an effectively low voltage.

In order to improve the emission efficiency of the first discharge, the second discharge is preferably generated by increasing the output voltage again after the first discharge is weakened. In the panel used in the present embodiment, the peak of the first discharge and the peak of the second discharge are preferably not less than 50 ns apart from each other. On the other hand, in order to generate the second discharge at a low voltage, the second discharge is preferably generated by increasing the voltage applied on the electrodes when the priming effect of the first discharge is still left. In the panel used in the present embodiment, the peak of the first discharge and the peak of the second discharge are preferably not more than 400 ns apart from each other.

Therefore, the peak of the first discharge and the peak of the second discharge are preferably not less than 50 ns and not more than 400 ns apart from each other. Furthermore, setting the time interval between the peaks of the two discharges not less than 100 ns and not more than 250 ns apart from each other can almost maximize the emission efficiency of the first discharge and can also make the emission efficiency of the second discharge sufficiently large. In the present embodiment, the repetition period of the sustain pulse is set to 5.4 μs, the time interval of the peaks of the two discharges is set to 150 ns, and ½ of the resonance period of electric power recovery parts 110 and 210 is set to 900 ns.

Figure 7:
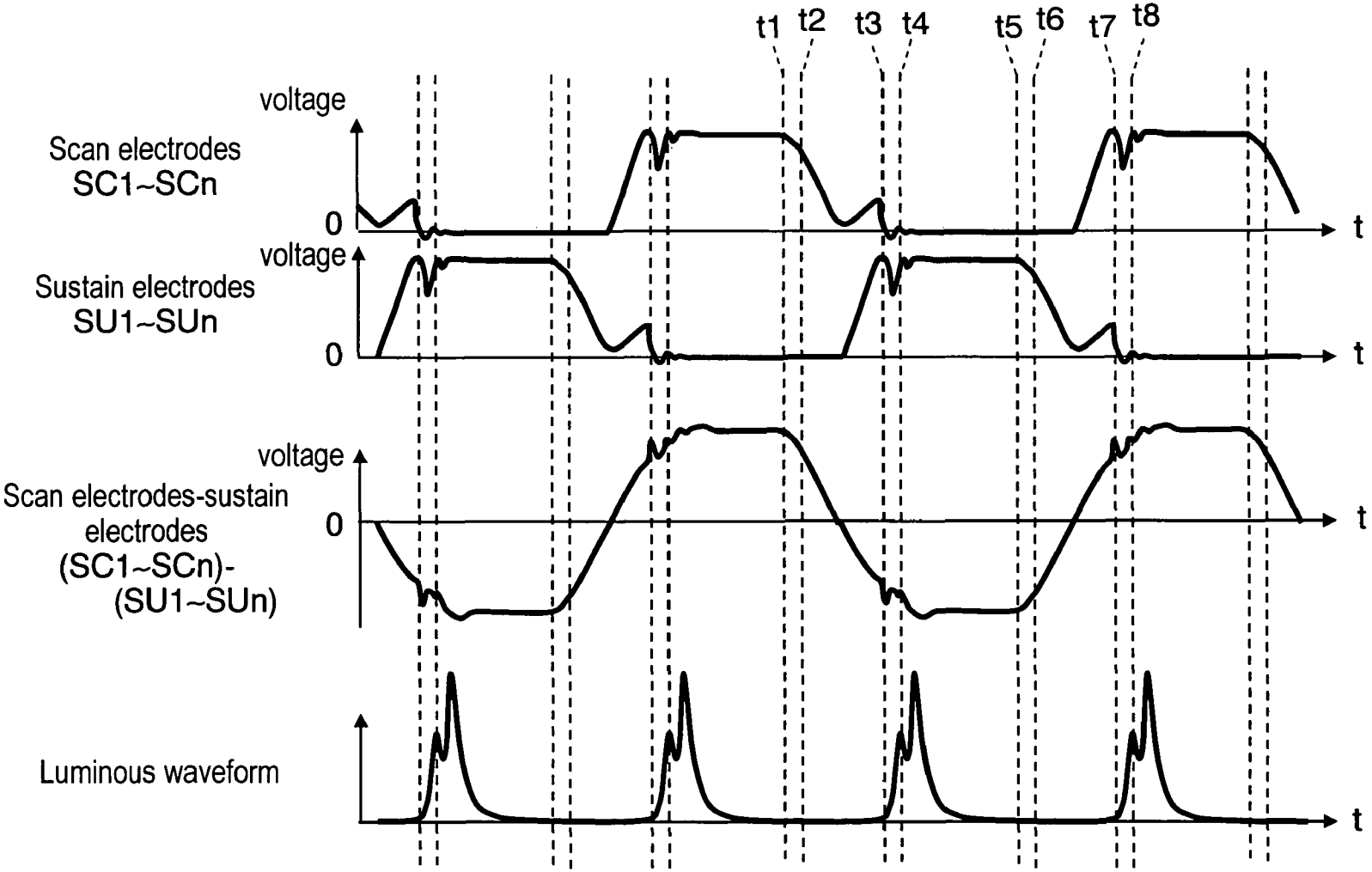
FIG. 7 is a view showing the applied voltage waveforms of the sustain pulse and measured values of the emission intensity in the image display device of the first embodiment.

FIG. 7 is a view showing the applied voltage waveforms of the first sustain pulse and the measured values of the emission intensity. The measured values of the applied voltage waveforms at the electrode terminals of scan electrodes 4 and sustain electrodes 5 are different from those of the voltage waveforms shown in FIG. 6. In particular, the rise time of the sustain pulse appears to be far behind time t2 and time t6. The reason for this is as follows. The interelectrode capacitance Cp is driven concurrently from both of the scan electrode 4 side and the sustain electrode 5 side. As a result, the drive waveforms on the electrode side on which the voltage change occurs later appear to be delayed by the effect of the drive waveforms on the electrode side on which the voltage change occurs earlier. However, the difference between the voltage applied to scan electrodes 4 and the voltage applied to sustain electrodes 5 (the voltage shown as "scan electrodes-sustain electrodes" in FIG. 7) indicates the following. A sufficient voltage is applied between the scan electrodes and the sustain electrodes, and after the voltage between the scan electrodes and the sustain electrodes exceeds the starting voltage, the first discharge is stably generated at time t3 or t7 in the discharge cell in which the write discharge has occurred. Thus, the first discharge is generated after the voltage between the display electrodes of the discharge cell in which a sustain discharge should be generated exceeds the starting voltage between the display electrodes. This indicates that the first discharge is not a so-called erasure discharge generated between the data electrodes and the scan electrodes, but a sustain discharge generated between the display electrodes. The second discharge is stably generated 150 ns after this.

As described hereinbefore, the sustain discharge using the first sustain pulse allows the stable generation of the two discharges with high emission efficiency. However, the two discharges may lose balance and have variation in luminance when the wall voltages on the display electrodes have variations for some reason. In the first embodiment of the present invention, the first sustain pulse train has a second sustain pulse added thereto for stably continuing the sustain discharge by stabilizing the wall voltages if the wall voltages have variations. The second sustain pulse is added and applied every time the first sustain pulse is applied a predetermined number of times in succession to at least one of the display electrodes.

The second sustain pulse will be described as follows.

Figure 8:
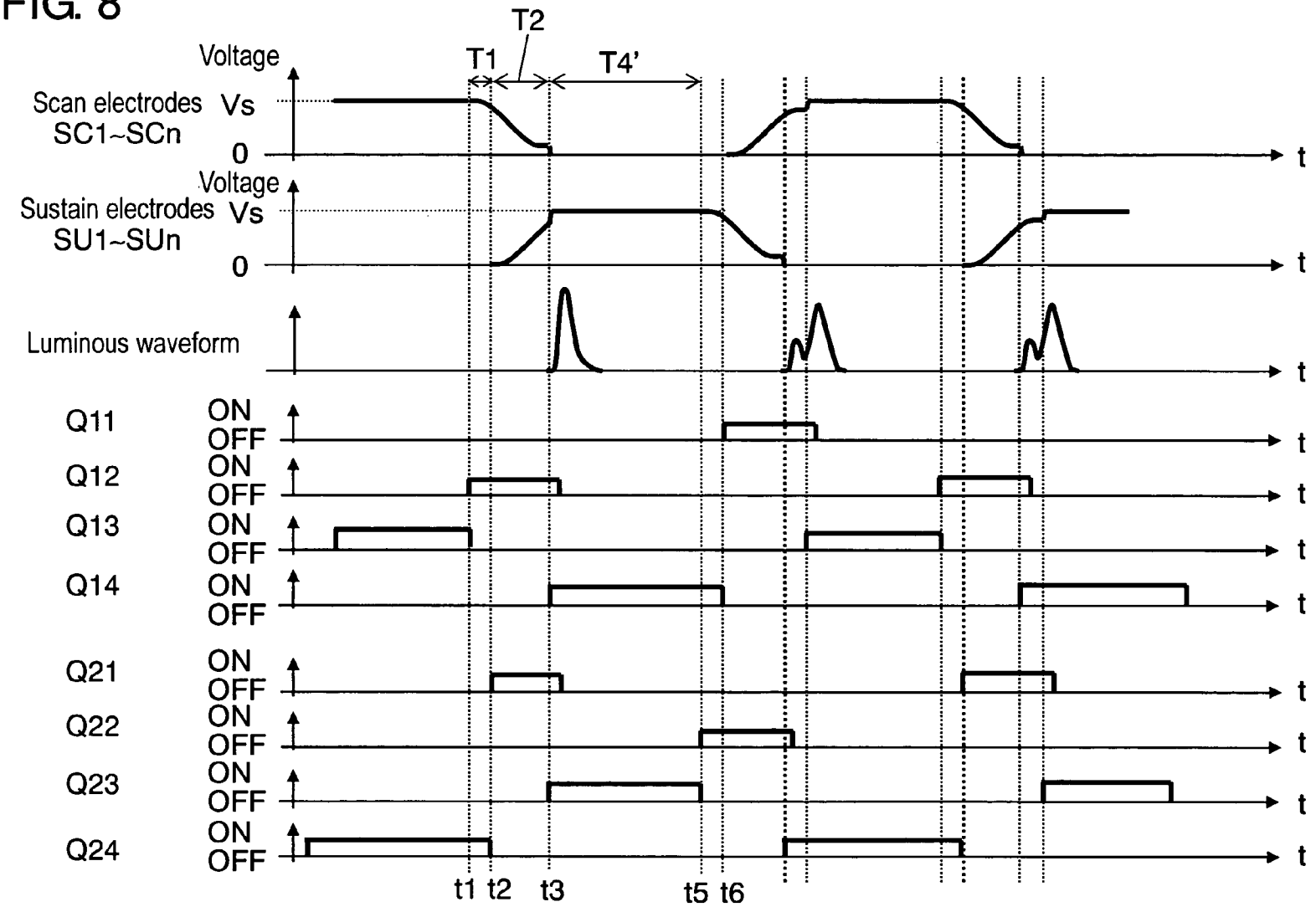
FIG. 8 is a timing chart showing details of a second sustain pulse in the image display device of the first embodiment.

FIG. 8 is a timing chart showing details of the second sustain pulse in the first embodiment of the present invention. The second sustain pulse can stabilize the wall voltages only by being added once every several number of the first sustain pulse. Therefore, the following description is on the assumption that the second sustain pulse is added once to the sustain electrode side; however, the second sustain pulse can be added to the scan electrode side to obtain the same effect.

(1) Period T1

At time t1, switching element Q12 is turned on. This causes the charge on the scan electrode 4 side to flow to capacitor C10 via inductor L10, diode D12, and switching element Q12, making the voltage of scan electrodes 4 begin to fall. Since inductor L10 and the interelectrode capacitance Cp form a resonance circuit, the voltage of scan electrodes 4 falls to around 0 (V) at time t3 when ½ of the resonance period has elapsed.

(2) Period T2

At time t2, switching element Q21 is turned on. This causes a current to flow from capacitor C20 for electric power recovery via switching element Q21, diode D21, and inductor L20, making the voltage of sustain electrodes 5 begin to rise. Since inductor L20 and the interelectrode capacitance Cp form a resonance circuit, the voltage of sustain electrodes 5 rise to around the Vs (V) when ½ of the resonance period has elapsed. The operation described so far is the same as that of the first sustain pulse.

(3) Period T4'

The second sustain pulse greatly differs from the first sustain pulse in that switching elements Q23 and Q14 are turned on before a sustain discharge is generated between scan electrodes 4 and sustain electrodes 5. In the first embodiment, switching element Q23 is turned on before time t4. More specifically, not only switching element Q14 but also switching element Q23 is turned on at time t3. When switching element Q14 is turned on at time t3, scan electrodes 4 are directly grounded via switching element Q14 and therefore the voltage of scan electrodes 4 is forced to 0 (V). Since switching element Q23 is turned on at the same time, sustain electrodes 5 are directly connected to power supply VS via switching element Q23, so that the voltage of sustain electrodes 5 is forced to the Vs (V). The voltage drop in scan electrodes 4 and the voltage rise in sustain electrodes 5 trigger the voltage difference between scan electrodes 4 and sustain electrodes 5 to exceed the starting voltage so as to generate a sustain discharge in the discharge cell in which a write discharge has occurred. In this case, the sustain discharge is very strong and the pulse duration (the length of period T4' shown in FIG. 8) is large, making it possible to accumulate wall charges many enough to reduce the electric field in the discharge cell. Therefore, when the wall voltages have variations for some reason, the wall voltages can be stabilized by generating a discharge with the second sustain pulse.

Switching element Q12 has only to be turned off after time t3 and before time t6, and switching element Q21 has only to be turned off after time t3 and before time t5. In order to reduce the output impedances of sustain pulse generators 100 and 200, it is preferable to turn off switching element Q14 immediately before time t6 and switching element Q23 immediately before time t5.

The timing of controlling switching elements Q21 and Q23 is not limited to the aforementioned one, but can be performed by turning switching elements Q23 and Q14 on before a sustain discharge is generated between scan electrodes 4 and sustain electrodes 5.

Figure 9A:
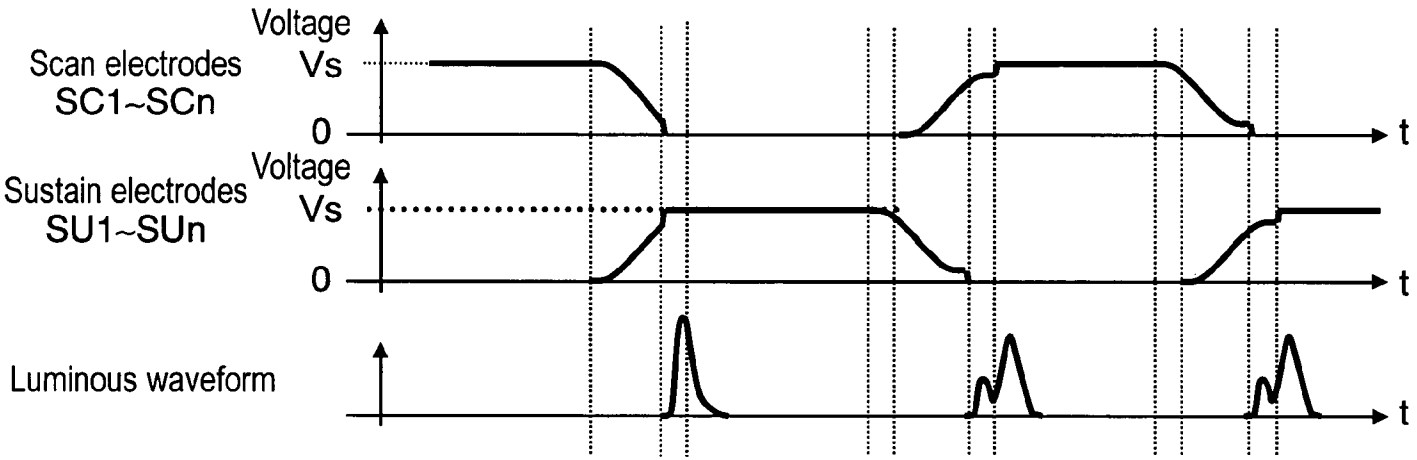
FIG. 9A is a timing chart showing details of a second sustain pulse in another embodiment.
Figure 9B:
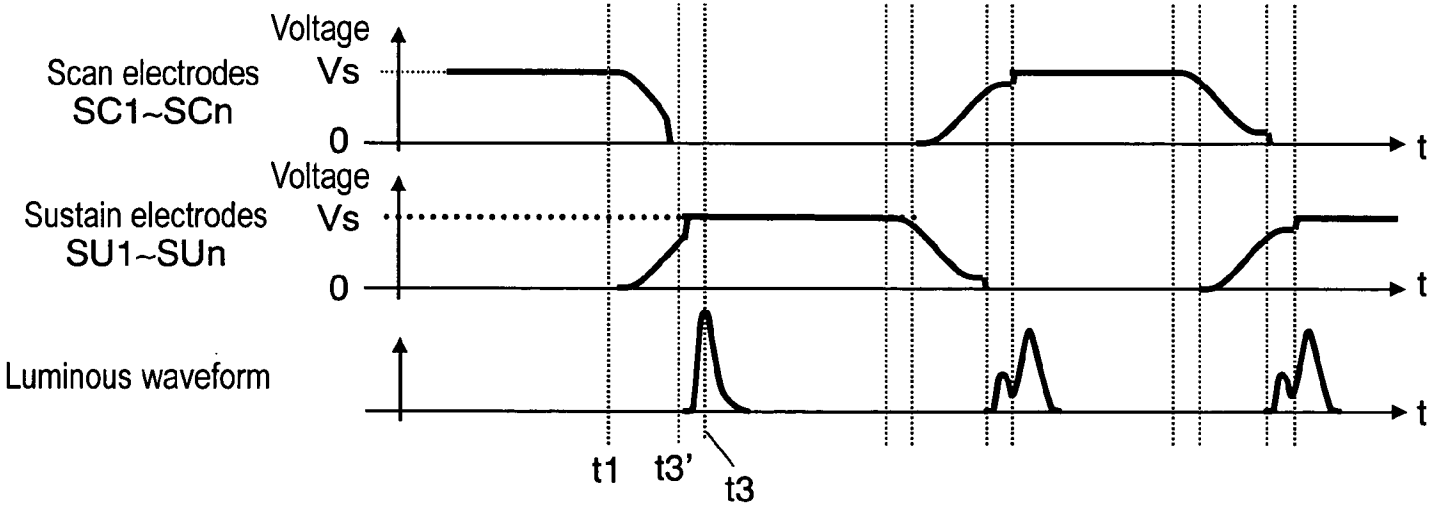
FIG. 9B is a timing chart showing details of a second sustain pulse in further another embodiment.

FIGS. 9A and 9*b* are timing charts showing details of a second sustain pulse in other embodiments. FIG. 9A shows a case where at time t1, not only switching element Q12 but also switching element Q21 is turned on, and at time t3' earlier than time t3, switching elements Q14 and Q23 are turned on at the same time. This control can extend the pulse duration, thereby further stabilizing the wall voltages. FIG. 9B shows a case where switching elements Q12 and Q21 are turned on at different times from each other, and switching elements Q14 and Q23 are turned on at different times from each other, but switching elements Q23 and Q14 are turned on before the generation of a sustain discharge. The sustain pulse could have another timing; however, in any case, switching elements Q23 and Q14 are turned on before a sustain discharge is generated between scan electrodes 4 and sustain electrodes 5. Therefore, the sustain discharge generated by the second sustain pulse becomes a one-time strong discharge unlike the discharge generated by the first sustain pulse.

As described above, the first sustain pulse in the first embodiment of the present invention generates the first discharge by forcibly reducing the voltage of the display electrodes on one side to 0 (V) first, and then generates the second discharge by forcibly increasing the voltage of the display electrodes on the other side to the Vs (V). However, it is alternatively possible to generate the first discharge by forcibly increasing the voltage of the display electrodes on one side to the Vs (V) first and then to generate the second discharge by forcibly decreasing the voltage of the display electrodes on the other side to 0 (V).

Second Exemplary Embodiment

Similar to the first embodiment, in a second embodiment of the present invention, a sustain discharge is performed using two kinds of sustain pulses: a first sustain pulse which can stably generate two consecutive discharges and a second sustain pulse which can stably continue the sustain discharge by stabilizing the wall voltages. The second embodiment differs from the first embodiment in that the rate of the second sustain pulse added to the first sustain pulse train is controlled in accordance with the image signal to be displayed. More specifically, the second sustain pulse is added to the first sustain pulse train after the first sustain pulse is applied a predetermined number of times in succession to the display electrodes, and the predetermined number of times is controlled in accordance with the image signal.

As the lighting rate of the discharge cells in the sustain period is larger, the wall voltages tend to have more variations, making the luminance variation noticeable. Therefore, in the present second embodiment, the proportion of the second sustain pulse is controlled to increase with increasing lighting rate.

Figure 10:
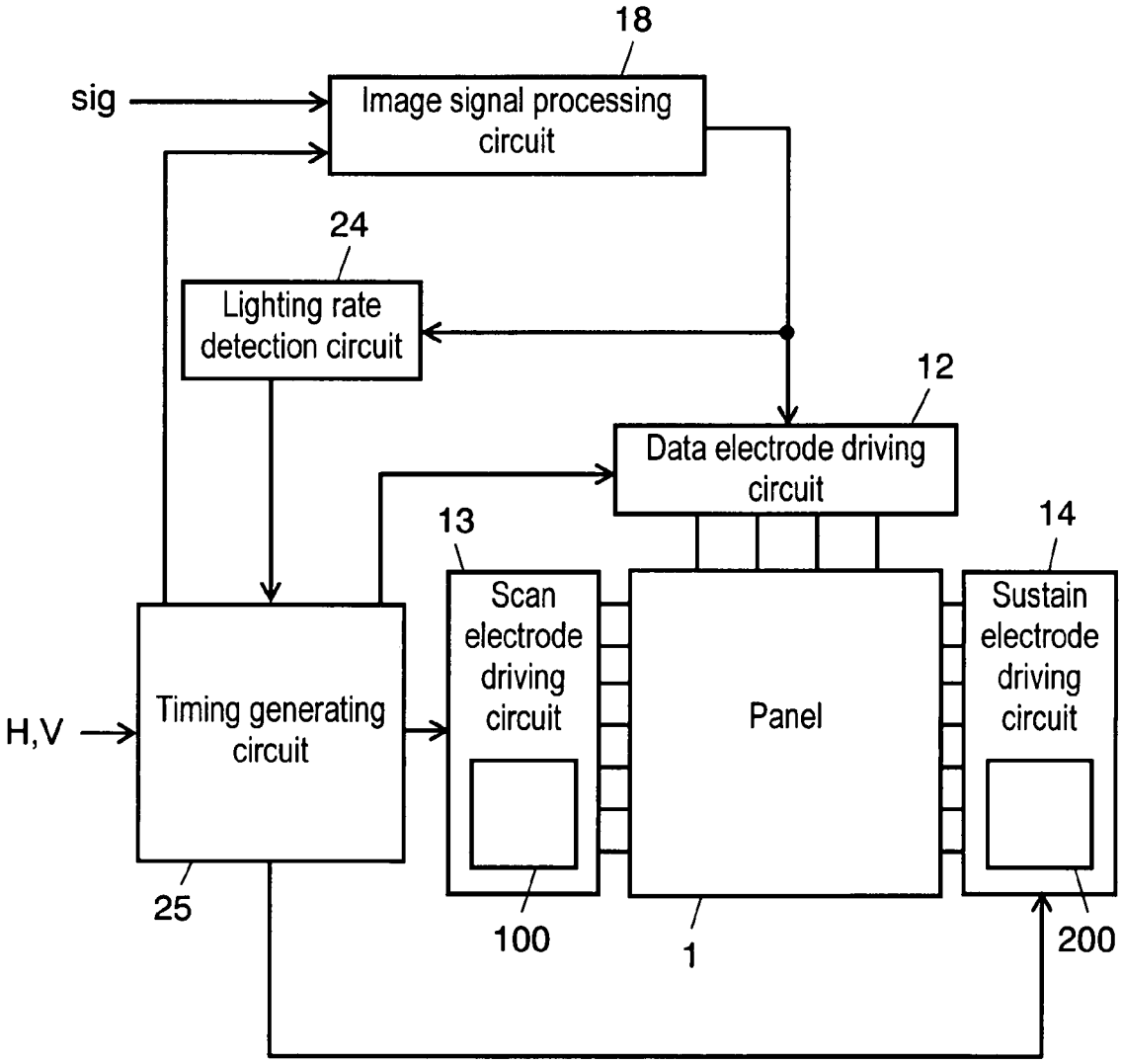
FIG. 10 is a circuit diagram of an image display device of a second embodiment of the present invention.
Figure 11A:
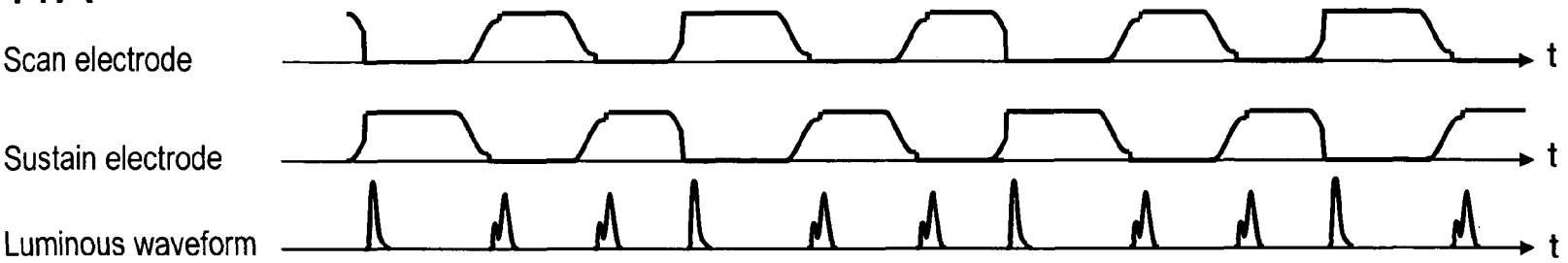
FIG. 11A is a schematic diagram of a sustain pulse of the image display device of the second embodiment of the present invention.
Figure 11B:
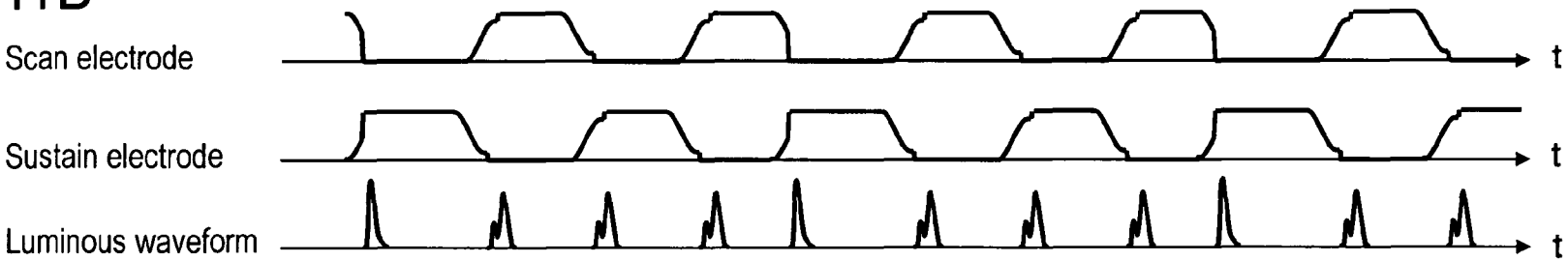
FIG. 11B is a schematic diagram of another sustain pulse of the image display device of the second embodiment of the present invention.
Figure 11C:
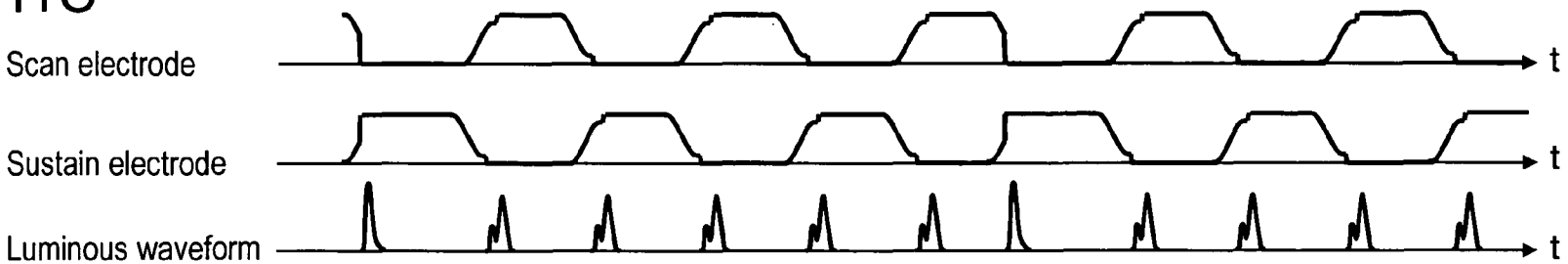
FIG. 11C is a schematic diagram of another sustain pulse of the image display device of the second embodiment of the present invention.

FIG. 10 is a circuit diagram of an image display device of the present embodiment. The same circuit blocks as those in the first embodiment will be referred to with the same reference numerals as those in FIG. 3, and their description will be omitted. FIG. 10 further includes lighting rate detection circuit 24. Lighting rate detection circuit 24 calculates a lighting rate for each subfield, that is, the proportion of discharge cells in which a sustain discharge is generated, based on the image signal "sig". Timing generating circuit 25 controls drive voltage waveforms based on the horizontal synchronizing signal H, the vertical synchronizing signal V, and the lighting rate signal outputted from lighting rate detection circuit 24. More specifically, the control is performed so that the second sustain pulse is added at a high rate to the first sustain pulse train in a subfield with a high lighting rate, and at a low rate in a subfield with a low lighting rate. FIGS. 11A, 11B, and 11C are schematic diagrams of sustain pulses of the image display device of the second embodiment of the present invention. FIG. 11A shows a sustain pulse when the pulse rate of the second sustain pulse is ⅓, that is, when the predetermined number of times to apply the first sustain pulse=2. FIG. 11B shows a sustain pulse when the pulse rate of the second sustain pulse is ¼, that is, when the predetermined number of times to apply the first sustain pulse=3. FIG. 11C shows a sustain pulse when the pulse rate of the second sustain pulse is ⅙, that is, when the predetermined number of times to apply the first sustain pulse=5. The pulse rate of the second sustain pulse is controlled to be 0 when the lighting rate is 0% to 5%, to be ⅙ when the rate is 5% to 20%, to be ¼ when the rate is 20% to 50%, and to be ⅓ when the rate is 50% or more.

As described hereinbefore, the sustain discharge using the first sustain pulse can stably generate two discharges with high emission efficiency. Adding the second sustain pulse to the first sustain pulse train can stabilize the wall voltages on the display electrodes when the wall voltages have variation for some reason, thereby stably continuing the two consecutive sustain discharges. The proportion of the second sustain pulse is controlled to increase with increasing lighting rate. Therefore, the proportion of the first pulse can be increased when the wall voltages are unlikely to decrease so as to improve emission efficiency, and the proportion of the second pulse can be increased when the wall voltages are likely to have more variations so as to stabilize the wall voltages. As a result, the image display device can be driven by an optimum sustain pulse in accordance with the image signal.

The present invention is useful as an image display device and other similar devices which can improve emission efficiency by stably generating two consecutive discharges.

The invention claimed is:

1. An image display device, comprising:

a plasma display panel including a plurality of discharge cells and a plurality of pairs of display electrodes, each discharge cell having a pair of display electrodes; and a pair of sustain pulse generators for each pair of display electrodes applying one of a first sustain pulse and a second sustain pulse to the pair of display electrodes, the first sustain pulse generating a sustain discharge twice in the plurality of discharge cells when a voltage applied between the pair of display electrodes changes, and the second sustain pulse generating a sustain discharge once in the plurality of discharge cells when the voltage applied between the pair of display electrodes changes, wherein each of the pair of sustain pulse generators includes:

an electric power recovery part for applying a voltage by charging and discharging the pair of display electrodes by a resonance between an inductor for electric power recovery and an electrostatic capacitance between the pair of display electrodes; and a clamp circuit for applying a voltage by being connected to one of a predetermined power supply and a ground potential, wherein the first sustain pulse is performed:

first by applying a rising voltage to one of the pair of display electrodes using the electric power recovery part corresponding to the one of the pair of display electrodes; and by applying a falling voltage to another of the pair of display electrodes using the electric power recovery part corresponding to the other of the pair of display electrodes so that the rising voltage and the falling voltage change concurrently;

next by forcing a voltage to ground potential for the other of the pair of display electrodes using the clamp circuit corresponding to the other of the pair of display electrodes so as to generate a first discharge, and then by applying a voltage from the predetermined power supply to the one of the pair of display electrodes using the clamp circuit corresponding to the one of the pair of display electrodes in a latter part of a period in which the rising and falling voltage change concurrently so as to generate a second discharge, and the second sustain pulse is performed:

first by applying a rising voltage to the one of the pair of display electrodes using the electric power recovery part corresponding to the one of the pair of display electrodes and by applying a falling voltage to the other of the pair of display electrodes using the electric power recovery part corresponding to the other of the pair of display electrodes so that the rising voltage and the falling voltage change concurrently; and next by applying the voltage of the predetermined power supply to the one of the pair of display electrodes using the clamp circuit corresponding to the one of the pair of display electrodes and by applying the voltage to ground potential for the other of the pair of display electrodes using the clamp circuit corresponding to the other of the pair of display electrodes at the same time so as to generate a discharge once, wherein the second sustain pulse is applied after the first sustain pulse is applied a predetermined number of times in succession.

2. The image display device of claim 1, further comprising:

a lighting rate detection circuit that calculates a lighting rate which is a proportion of the plurality of discharge cells in which the sustain discharge for each subfield is generated, wherein a proportion of the second sustain pulse in a subfield is controlled to increase with increasing lighting rate.

* * * * *